US009594391B2

(12) United States Patent
de Cremoux

(10) Patent No.: US 9,594,391 B2
(45) Date of Patent: Mar. 14, 2017

(54) HIGH-VOLTAGE TO LOW-VOLTAGE LOW DROPOUT REGULATOR WITH SELF CONTAINED VOLTAGE REFERENCE

(71) Applicant: Dialog Semiconductor GmbH, Kirchheim/Teck-Nabern (DE)

(72) Inventor: Guillaume de Cremoux, Edinburgh (GB)

(73) Assignee: Dialog Semiconductor (UK) Limited, Reading (GB)

( * ) Notice: Subject to any disclaimer, the term of this patent is extended or adjusted under 35 U.S.C. 154(b) by 240 days.

(21) Appl. No.: 14/445,186

(22) Filed: Jul. 29, 2014

(65) Prior Publication Data

US 2016/0026204 A1 Jan. 28, 2016

(30) Foreign Application Priority Data

Jul. 24, 2014 (EP) ..... 14178436

(51) Int. Cl.

| | |
|---|---|
| ***G05F 3/22*** | (2006.01) |
| ***G05F 3/24*** | (2006.01) |
| ***G05F 3/30*** | (2006.01) |
| ***G05F 3/08*** | (2006.01) |
| *G05F 1/46* | (2006.01) |
| *G05F 1/567* | (2006.01) |

(52) U.S. Cl.

CPC ..... *G05F 3/08* (2013.01); *G05F 3/30* (2013.01); *G05F 1/462* (2013.01); *G05F 1/567* (2013.01); *G05F 3/222* (2013.01); *G05F 3/242* (2013.01)

(58) Field of Classification Search

CPC ..... G05F 3/02; G05F 3/08; G05F 3/10; G05F 3/16; G05F 3/20; G05F 3/26; G05F 3/262; G05F 3/265; G05F 3/267; G05F 3/30

USPC ..... 323/301, 311–317

See application file for complete search history.

(56) References Cited

U.S. PATENT DOCUMENTS

| | | | | |
|---|---|---|---|---|
| 4,672,304 A | | 6/1987 | Degrauwe et al. | |
| 5,686,821 A | * | 11/1997 | Brokaw | G05F 1/575 323/273 |
| 5,804,958 A | * | 9/1998 | Tsui | G05F 3/262 323/313 |

(Continued)

FOREIGN PATENT DOCUMENTS

| | | |
|---|---|---|
| EP | 0188401 | 7/1986 |
| WO | WO 2009/013572 | 1/2009 |

OTHER PUBLICATIONS

"AD580 Analog Devices," High Precision, 2.5 V/C Reference, 2004 Analog Devices, Inc., pp. 1-8.

(Continued)

*Primary Examiner* — Jessica Han
*Assistant Examiner* — David A. Singh
(74) *Attorney, Agent, or Firm* — Saile Ackerman LLC; Stephen B. Ackerman

(57) ABSTRACT

A circuit and method for providing a temperature compensated voltage comprising a voltage regulator circuit configured to provide a regulator voltage, a voltage reference circuit configured to provide a reference voltage, VREF, a comparison circuit configured to provide a control voltage VCTL, and an operational amplifier configured to provide amplification and coupling to said comparison circuit, wherein the voltage can be a high voltage greater than 1.2 V.

18 Claims, 8 Drawing Sheets

(56) References Cited

U.S. PATENT DOCUMENTS 6,271,652 B1* 8/2001 Burstein ..... G05F 3/30 323/313
6,445,167 B1* 9/2002 Marty ..... G05F 1/468 323/274
6,512,398 B1 1/2003 Sonoyama et al.
6,995,587 B2 2/2006 Xi
7,030,598 B1* 4/2006 Dow ..... G05F 1/575 323/313
7,157,892 B1 1/2007 Ritter
8,922,178 B2* 12/2014 Zhong ..... G05F 1/567 323/273
2003/0137287 A1* 7/2003 Marie ..... G05F 3/30 323/314
2007/0159145 A1* 7/2007 Liwinski ..... G05F 1/46 323/280
2008/0238400 A1* 10/2008 Dobkin ..... G05F 3/30 323/313
2008/0315855 A1* 12/2008 Xiao ..... G05F 3/30 323/313
2009/0243713 A1* 10/2009 Marinca ..... G05F 3/30 327/542
2009/0302823 A1* 12/2009 Chao ..... G05F 3/30 323/313
2010/0134087 A1* 6/2010 Hwang ..... G05F 3/16 323/313
2010/0148857 A1* 6/2010 Chellappa ..... G05F 3/242 327/538
2011/0025285 A1* 2/2011 Hirose ..... G05F 3/242 323/284
2011/0074495 A1* 3/2011 Duval ..... G05F 3/30 327/539
2011/0156690 A1 6/2011 Fujiyama
2012/0068673 A1* 3/2012 Stellberger ..... G05F 1/575 323/269
2013/0033245 A1* 2/2013 Wong ..... G05F 3/30 323/281
2013/0328615 A1* 12/2013 Sano ..... G05F 3/30 327/513
2014/0015509 A1* 1/2014 Gupta ..... G05F 3/30 323/313
2014/0077791 A1* 3/2014 Zhang ..... G05F 3/30 323/314
2015/0205319 A1* 7/2015 De Cremoux ..... H02M 3/18 331/109
2016/0308537 A1* 10/2016 Goumballa ..... H03K 3/011

OTHER PUBLICATIONS

European Search Report 14178436.3-1807, Jan. 26, 2015, Dialog Semiconductor GmbH.

* cited by examiner

HIGH-VOLTAGE TO LOW-VOLTAGE LOW DROPOUT REGULATOR WITH SELF CONTAINED VOLTAGE REFERENCE

BACKGROUND

Field

The disclosure relates generally to a voltage regulator and, more particularly, to a low dropout regulator thereof.

Description of the Related Art

Low dropout (LDO) regulators are commonly used to regulate internal voltage supplies at lower voltage from higher voltages. Voltage regulation is important where circuits are sensitive to transients, noise and other types of disturbances. The control of the regulated voltage over variations in both semiconductor processes and temperature is key to many applications. Additionally, power consumption is also a key design requirement.

FIG. 1 is a circuit schematic of a prior art low dropout (LDO) regulator with separate bandgap network. FIG. 1 consists of three stages. The first stage, stage 1, establishes the voltage reference. The second stage, stage 2, is the voltage regulator that uses this reference to make a regulated rail, VREG. The third stage, stage 3, is the Power-On-Reset, which measures the regulated voltage, VREG and generates a rising edge on its output port when the regulated voltage VREG exceeds a given percentage of its intended regulated value. It is desirable to merge the reference voltage, VREF, and regulated voltage generator, VREG, by directly creating a voltage that is temperature compensated.

FIG. 1 shows the circuit power supply voltage VDD 10, and ground VSS 20. The network can be understood as three stages. The first stage provides a voltage reference, VREF, as its output. The second stage consists of an operational amplifier, and a feedback loop which serves as a control of the regulator output transistor. The third stage establishes the regulated voltage, VREG, with a pass transistor, and a load. In the third stage, the output voltage of the network is VOUT 30 which is also the regulated voltage VREG. The first operational amplifier OA1 40 produces a reference voltage VREF and is electrically connected to a second operational amplifier OA2 50. The second operational amplifier OA2 50 is electrically coupled to the PFET output device 60. The PFET 60 is electrically coupled to the output VOUT 30 and load element 55. The operational amplifier OA2 50 has a first input 51 and second input 52. The OA2 input signal 52 is connected to a resistor feedback network formed from resistor RLH 53, and resistor RLL 54. In the first stage, a resistor RF 70 and resistor RF 75 are electrically coupled to the first and second input of operational amplifier OA1 40. Additionally, resistor RF 70 and RF 75 are coupled to the npn transistors NPN1, and NPN2, respectively. The npn transistor NPN1 80 is coupled to resistor element RPTAT 90. The npn transistor NPN2 85 is coupled to resistor element RA 95.

FIG. 2 is a circuit schematic of a network that provides an R-SHIFT method. FIG. 2 shows a prior art bandgap circuit schematic. From the FIG. 2 circuit schematic, an R-SHIFT method is described. In the circuit 200, the voltage supply VDD 210 supports the network, with a ground VSS 220. The output voltage is the regulated voltage VREG 230 at the output voltage. The operational amplifier OA1 240 provides an output signal to the gate of the PMOS pass transistor 260. A first resistor RF1 270 and second resistor RF2 275 are electrically coupled to the operational amplifier OA1 240. Additionally, there are a first and second device represented as a first diode 280 of size 1, and a second diode 285 of size N. The resistor RPTAT 290 is coupled to the diode 285, RSHIFT resistor 250, and operational amplifier OA1 240.

A shift resistance RSHIFT increases the current through the resistances RF and shifts up from 1.2V to an arbitrarily value VREG. By setting properly RF, RSHIFT, RPTAT and N, VREG is directly compensated in temperature, but this comes at the cost of two very large resistors RF and an operational amplifier.

FIG. 3 illustrates a circuit schematic 300 that highlights the R-String method. In FIG. 3, the bandgap cell is indirectly regulated to 1.25 V through a resistor ladder network. The ground potential VSS is 320, and the output rail VOUT 310 is established by the resistor ladder network, and operational amplifier OA1 340. The regulated voltage node 330 is electrically coupled to the resistor ladder network resistor R3 350 and resistor R4 355. The inputs of the operational amplifier OA1 340 are coupled to resistor RF1 370 and resistor RF2 375. The npn transistors 380 and 385 are coupled to the OA1 input signals. Resistor R1 390 (PTAT resistor), and resistor R2 395 are coupled to the npn transistor 380 and 385.

The output voltage, VOUT, VOUT=VREG is adjusted by the operational amplifier OA1 340 such that its fraction R4/(R3+R4) matches ~1.25V. Then it is possible to optimize only the left part (bandgap part) to compensate it in temperature, and so the same compensation will also result for VOUT=VREG.

FIG. 4 illustrates an additional circuit schematic 400. In the prior implementation of FIG. 3 there is a resistive path between VREG and ground VSS. This will require large resistor values which is not desirable. FIG. 4 is a circuit schematic 400 that utilizes a power supply voltage VDD 410 and ground potential 420. The npn transistor pair NPN1 480 (size N) and NPN2 485 (size 1) are coupled to resistor RPTAT 490 and resistor RS 495. The base of the npn transistors establishes the reference voltage VREF and is electrically connected to resistor RH 453, and resistor RL 454. The npn transistors are sourced by a current mirror formed by PFET 430A and PFET 430B. The current mirror PFET 430A is connected to the gate of the PFET MPLOOP 425. A second PFET current mirror is electrically coupled to the power supply voltage VDD 410 formed by PFET mirror 435A and 435B. The transistor MPLOOP 425 is coupled to an NFET current mirror 445A and 445B.

The disadvantage of this circuit topology is the sensitivity to the regulated voltage VREG. If the regulated voltage, VREG, has noise, it is amplified because the voltage is applied on the gate-to-source voltage of the MPLOOP.

FIG. 5 shows a circuit schematic of an indirect PTAT 500. The power supply VDD 510 and the ground reference VSS 520 supply circuit 500. The network has a PFET current mirror M1 530A and M3 530B. The output pass transistor is a PFET (e.g. PMOS) M4 540. The PFET current mirror maintains a controlled current through the NPN Q1 535 and NPN current mirror formed by Q2 545A and Q3 545B. The base of NPN Q1 is coupled to resistor R1 560, resistor R2 570, and resistor R3 580, as well as NPN Q4 550.

The PTAT effect is done by matching the current in Q2 545A (N elements) with the current in Q1 535 (1 element) through the VREG loop. VREG is adjusted for this matching and {R2 570, R3 580} allow adjusting the value of VREG. This implementation has the following disadvantages and drawbacks:

The loop gain is low, which leads to any fluctuation on VREG becoming a current (VREG-VBE4)/R2, which is then copied with a low ratio to Q1. Only the line VCTL offers the gain.

The PSRR is poor because VCTL is supplied as a reference voltage. Noise on the power supply node, VDD, is applied on VGSM4 and the loop needs to be very fast to compensate for this noise.

Mostly, it is not high-voltage compliant. For example, if the power supply voltage, VDD, is VDD=20V, then the gate of PMOS transistor M1 530A is 19V and npn Q1 535 will undergo electrical breakdown for a standard 5V process. If transistors are stacked, in a series cascode configuration, the series cascode can protect its collector; this leads to a non-starting loop because the cascades themselves need to be started, otherwise they are blocking the regulation path. The issue of high voltage compliance is also true for the transistor Q3 545B.

Addressing the issue with series cascode transistors is achievable, but with an impact on the minimum voltage of operation (e.g. series cascode configuration leads to multiple drain-to-source voltage drops (VDSsat).

U.S. Pat. No. 6,995,587 to Xi, describes a method for generating a bandgap reference current. The method for generating a bandgap reference current includes the steps for mirroring the bandgap reference current, summing the mirrored currents, and modulating and outputting a bandgap reference voltage from the sum. Representative preferred embodiments are disclosed in which the methods of the invention are used in providing under-voltage protection and in providing a regulated output voltage. Preferred embodiments of the invention include a bandgap under-voltage detection circuit using a comparator and a voltage regulator circuit having a regulated voltage output capability.

U.S. Pat. No. 6,512,398 to Sonoyama describes a circuit device with improved reliability by minimizing the fluctuations of the detection level of the supply voltage. The circuit device comprises a differential amplifier circuit that amplifies the differential voltage representing the difference between the reference voltage $V_{REF}$ generated by a reference voltage generating section and the detection voltage obtained by dividing a supply voltage. The reference voltage generating section generates reference voltage $V_{REF}$ from the base-emitter voltage of a bipolar transistor.

A bandgap voltage reference is discussed in the Analog Devices data sheet for AD580. The AD580 Data Sheet discloses a 3-terminal, low cost, temperature-compensated, bandgap voltage reference, which provides a fixed 2.5V output for inputs between 4.5V and 30V. A unique combination of advanced circuit design and thin film resistors provide the AD580 with an initial tolerance of ±0.4%, a temperature stability of better than 10 ppm/° C., and long-term stability of better than 250 pV.

In these prior art embodiments, the solution to establish an efficient voltage regulator utilized various alternative solutions.

SUMMARY

It is desirable to provide a solution to address an efficient voltage regulator with minimal power consumption.

A principal object of the present disclosure is to provide a circuit with a loop gain VCTL with a ground reference for better power supply rejection ratio (PSRR) and noise immunity.

Another further object of the present disclosure is to provide a circuit that utilizes field effect transistors that are voltage tolerant to high voltage.

Another further object of the present disclosure is to provide a circuit that utilizes high voltage field effect transistors to avoid series-cascode of the bipolar junction transistors.

In summary, a circuit providing a temperature compensated voltage comprises a voltage regulator circuit configured to provide a regulator voltage, a voltage reference circuit configured to provide a reference voltage, a startup circuit configured to provide a control voltage VCTL, and an operational amplifier configured to provide amplification and coupling to said startup circuit.

In addition, a method is disclosed in accordance with the embodiment of the disclosure. A method of providing a temperature compensated high voltage comprises the steps of: 1) providing a circuit on a semiconductor chip, the circuit comprising a voltage reference generator, and a voltage regulator generator; 2) establishing a current in transistor QN; 3) copying the current onto transistor QN1; 4) copying the current back to current mirror {MP1, MPN}; 5) comparing the current in transistor Q1 to current in transistor QN to establish a voltage VCTL; 6) driving the current-mode operational amplifier {MNOA, MPOA, and MP}; and 7) adjusting a regulator voltage VREG to match currents in transistor Q1 and QN.

Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1:
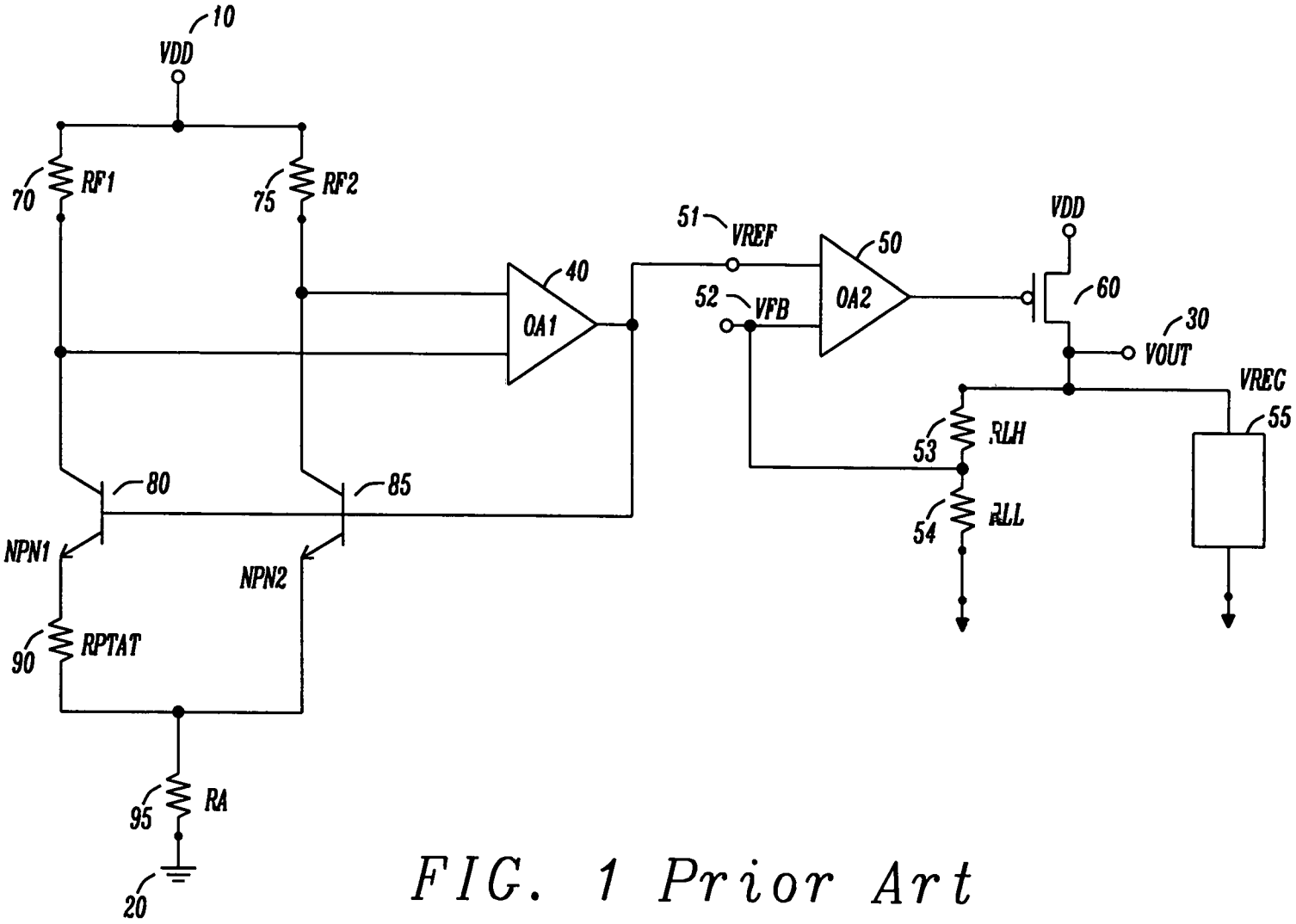
FIG. 1 Prior Art
FIG. 1 is a circuit schematic of a prior art low dropout (LDO) regulator with separate bandgap network.
Figure 2:
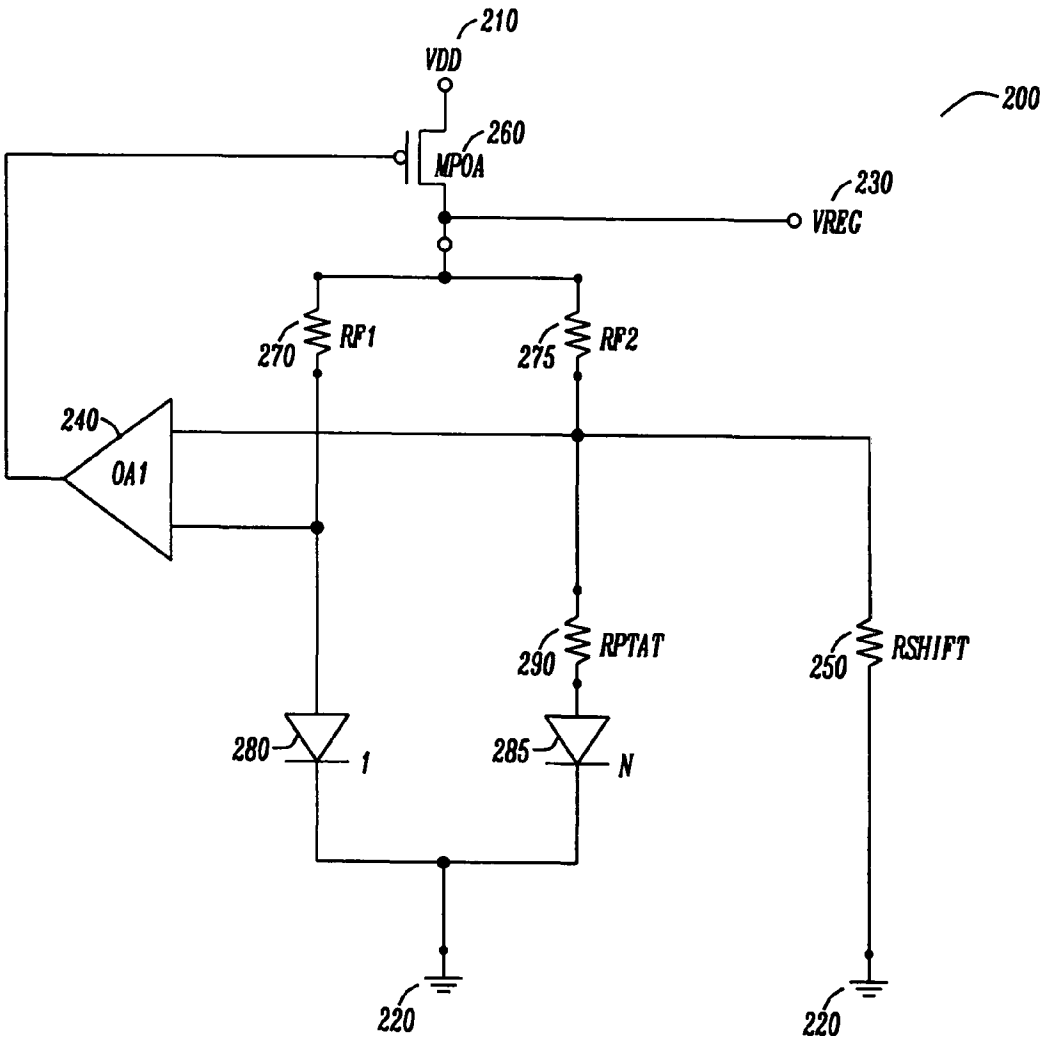
FIG. 2 Prior Art
FIG. 2 is a circuit schematic of a prior art network that is T-compensated using a shift resistance to regulate a voltage above the conventional ~1.20V value.
Figure 3:
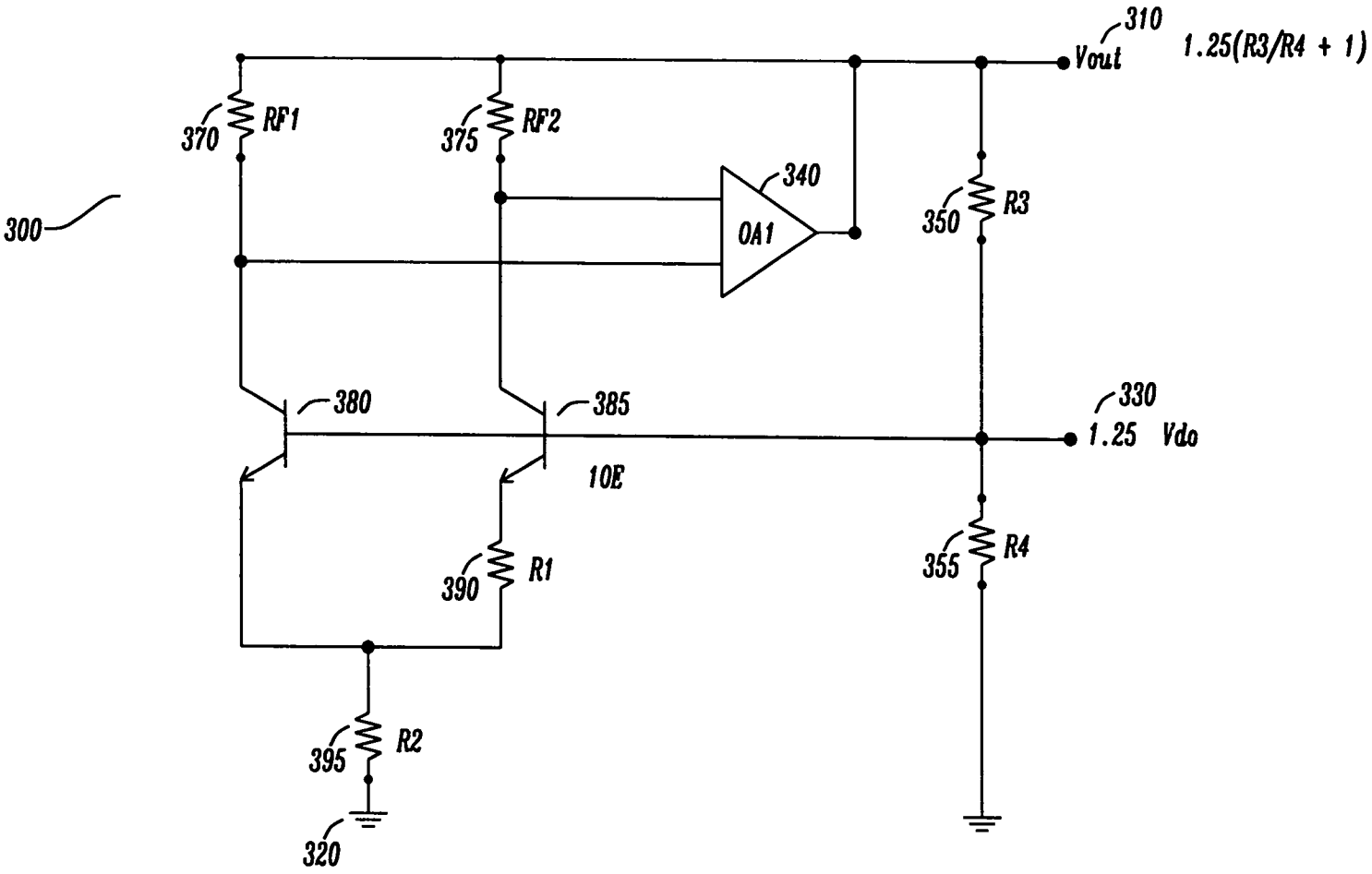
FIG. 3 Prior Art
FIG. 3 is a circuit schematic of a prior art network highlighting the R-string method.
Figure 4:
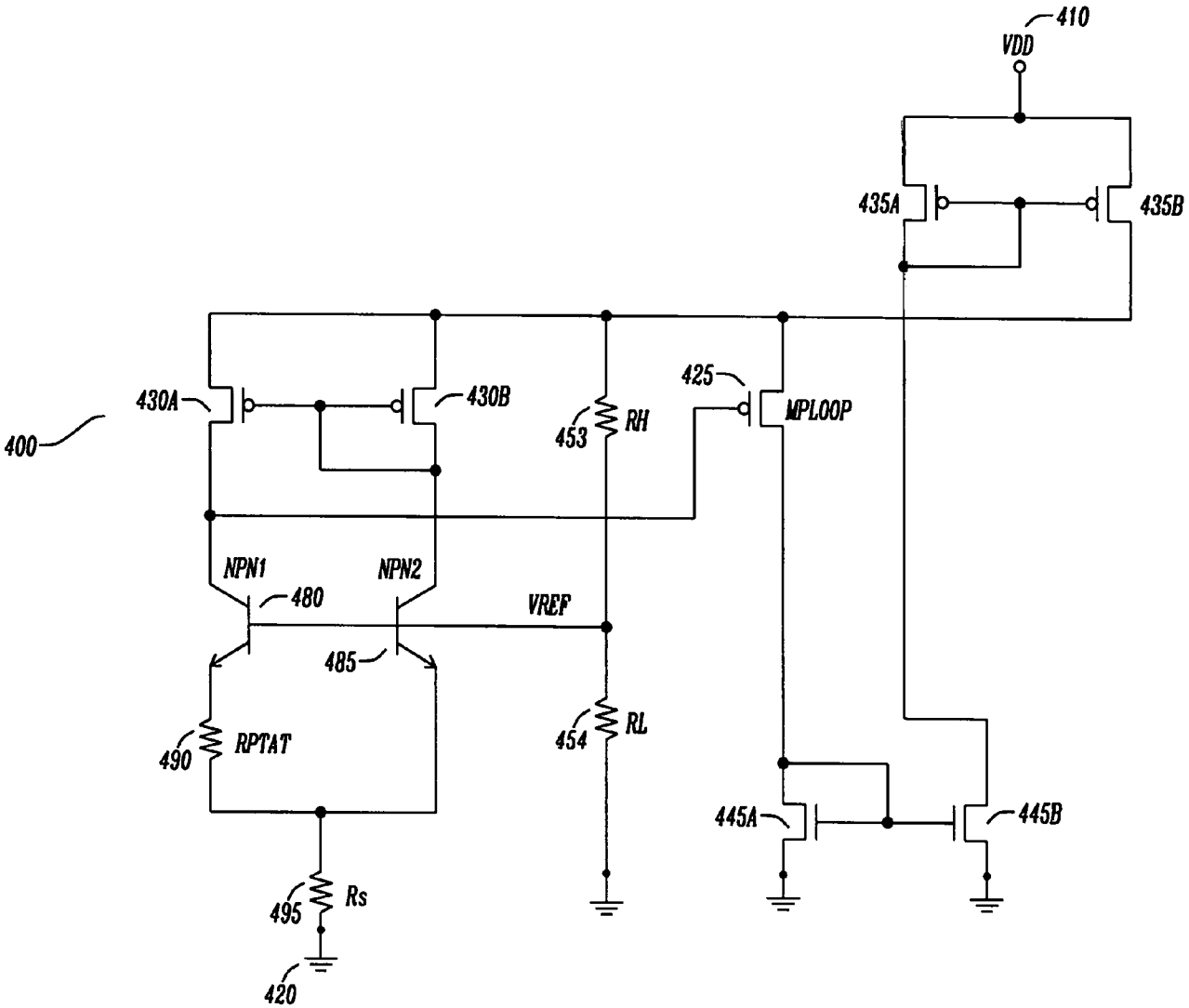
FIG. 4 Prior Art
FIG. 4 is a circuit schematic of a prior art improved network of the R-string method network of FIG. 3.
Figure 5:
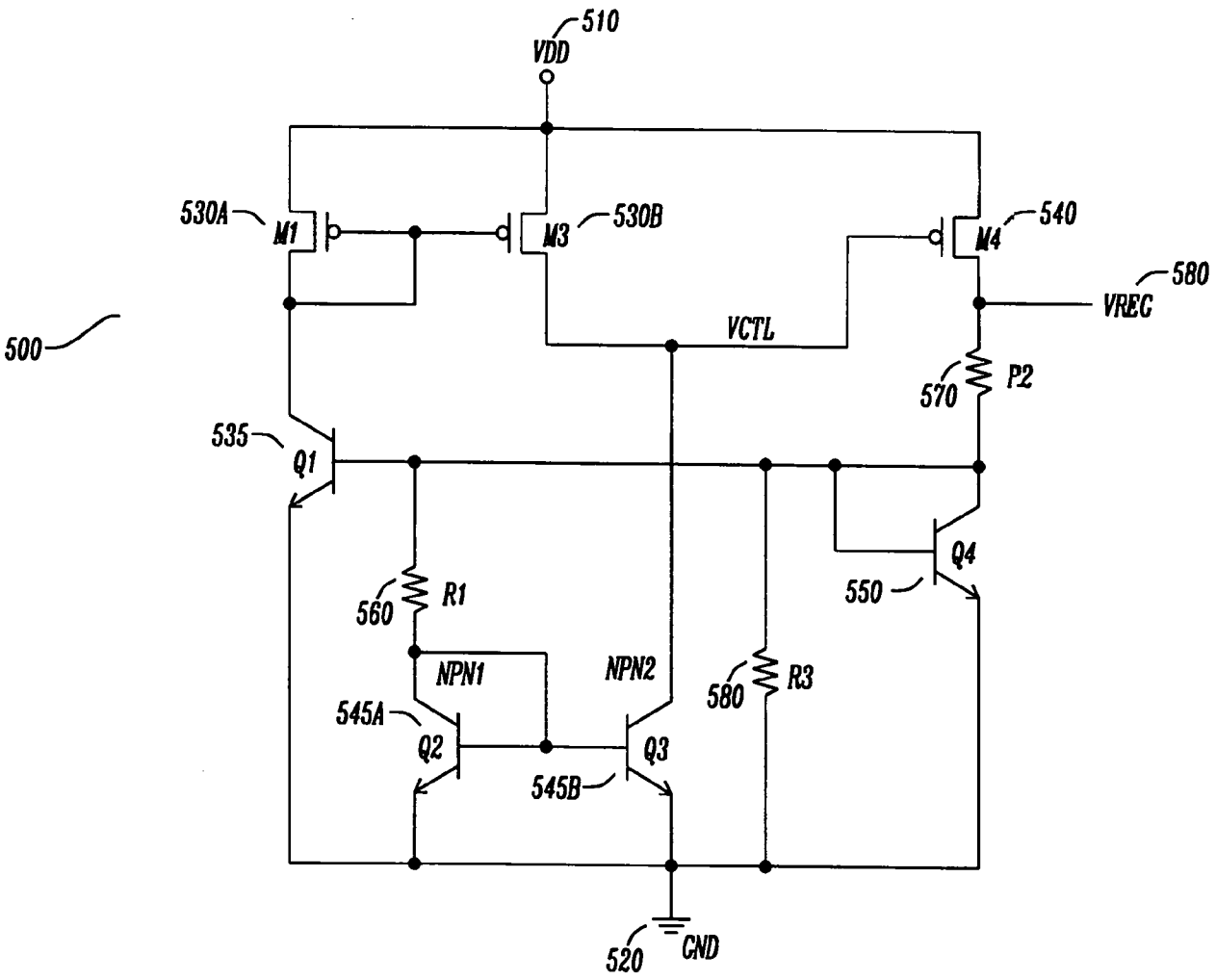
FIG. 5 Prior Art
FIG. 5 is a circuit schematic of a prior art network for Indirect PTAT.
Figure 6:
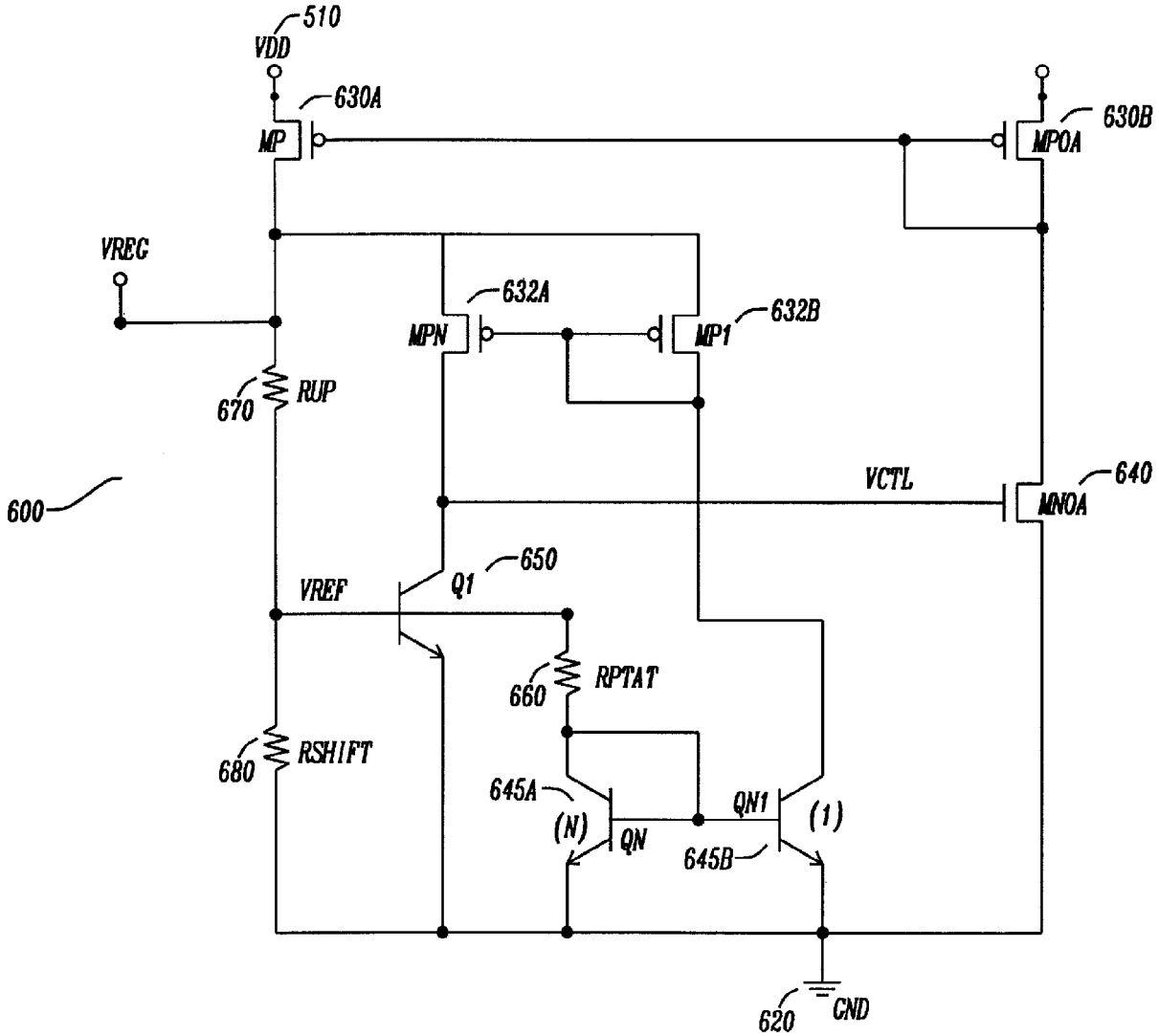
FIG. 6 is a circuit schematic in accordance with the first embodiment of the disclosure.

FIG. 6 is a circuit schematic in accordance with the first embodiment of the disclosure. The circuit 600 comprises a power supply 610 and a ground VSS 620. A first p-channel MOSFET current mirror MP 630A and MP 630B sources the circuit 600. A second p-channel MOSFET current mirror MPN 632A and MP1 632B is electrically coupled to p-channel MOSFET MP 630A. The second p-channel MOSFET current mirror provides a 1:N MOSFET width ratio, where transistor MPN 632A has a MOSFET width which is N times wider than transistor MP1 632B. The second p-channel MOSFET current mirror transistor MP1 632B is driven by the current flowing through the collector of the bipolar transistor QN1 645B. The bipolar transistor QN1 645B forms an n-type bipolar current mirror with a second bipolar transistor QN 645A. The second p-channel MOSFET current mirror MPN 632A sources the collector of the bipolar transistor Q1 650 The emitter of the bipolar transistor Q1 650 is electrically connected to the ground VSS 620. The base of the bipolar transistor Q1 650 is electrically coupled to the resistor RPTAT 660, and the resistor network RUP 670 and RSHIFT 680. The p-channel MOSFET MPOA 630B is driven by the current flowing through the n-channel MOSFET MNOA 640. The gate of the n-channel MOSFET MNOA 640 is the control voltage VCTL. In the circuit 600, the collector-to-emitter current in bipolar transistor QN 645A is mirrored onto bipolar transistor QN1 645B with the ratio N:1. Using a current mirror (QN 645A, QN 645B) limits the current consumption. The current is then copied back to the p-channel current mirror MP1 632B and MPN 632A where the 1:N ratio restores the previous N:1 scaling. Thus, the current in bipolar transistor Q1 650 is compared to the current to QN 645A and the result pushes or pulls the signal line voltage VCTL. This establishes a drive current which establishes the current-mode operational amplifier formed from n-channel MOSFET MNOA 640, and current mirror p-channel MOSFET MPOA 630B and p-channel MOSFET MP 630A, where the ratio MPOA:MP can be very large to be able to inject more current to the output.

The regulator voltage, VREG, is adjusted such that the signal voltage VCTL drives a given current through n-channel transistor MNOA 640; this allows prevention of signal clipping of the signal VCTL. (e.g. VCTL is not clipping up nor down). The regulator voltage VREG is adjusted to match the currents in bipolar transistor Q1 650 and bipolar transistor QN 645A. This method emulates a PTAT, with the advantage that the regulation voltage itself is referenced to the ground VSS 620.

The derivation of the regulation voltage VREG is illustrated in the following equations. First, equate the currents of transistor QN 645A, and transistor Q1 650 where IQN=IQ1. This can be expressed as $$I(RPTAT) = \frac{VBE1 - VBEN}{RPTAT} = \frac{\Delta VBE}{RPTAT}$$

The regulation voltage, VREG can expressed as $$VREG = VBE1 + RUP \cdot I(RUP) = VBE1 + RUP \cdot (I(RSHIFT) + I(RPTAT))$$

$$VREG = VBE1 + RUP \cdot \left(\frac{VBE1}{RSHIFT} + \frac{\Delta VBE}{RPTAT}\right)$$

The regulation voltage can be expressed as a ratio of the resistors RPTAT 660, resistor RUP 670, and RSHIFT 680

$$VREG = VBE1 \cdot \left(1 + \frac{RUP}{RSHIFT}\right) + \Delta VBE \cdot \left(\frac{RUP}{RPTAT}\right)$$

This equation is made of a base-emitter voltage, VBE1 term that decreases with temperature, and a □VBE term that increases with temperature. By calculating properly RUP, RPTAT, RSHIFT and N (that is embedded in □VBE), the value of VREG can be chosen and also compensated in temperature.

Figure 7:
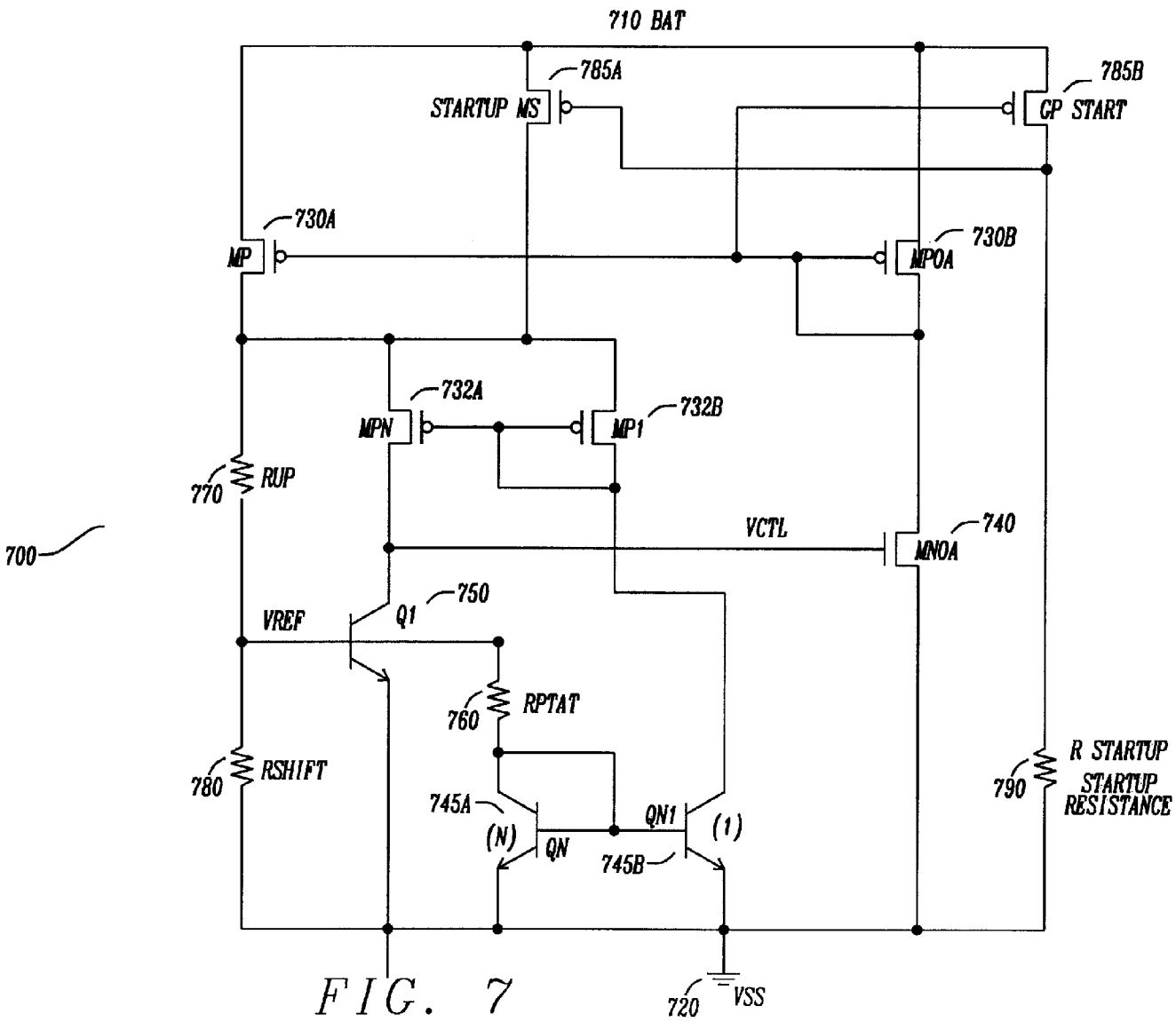
FIG. 7 is a circuit schematic in accordance with the second embodiment of the disclosure; and, FIG. 8 is a method in accordance with the embodiment of the disclosure.

FIG. 7 is a circuit schematic in accordance with the second embodiment of the disclosure. The circuit 700 comprises a power supply VDD 710 and a ground VSS 720. The circuit 700 power supply can be a battery power source (e.g. VDD=VBAT). A p-channel MOSFET current mirror MP 730A and MP 730B sources the circuit 700. A second p-channel MOSFET current mirror MPN 732A and MP1 732B is electrically coupled to p-channel MOSFET MP 730A. The second p-channel MOSFET current mirror provides a 1:N MOSFET width ratio, where transistor MPN 732A has a MOSFET width which is N times wider than transistor MP1 732B. The second p-channel MOSFET current mirror transistor MP1 732B is driven by the current flowing through the collector of the bipolar transistor QN1 745B. The bipolar transistor QN1 745B forms an n-type bipolar current mirror with a second bipolar transistor QN 745A. The second p-channel MOSFET current mirror MPN 732A sources the collector of the bipolar transistor Q1 750. The emitter of the bipolar transistor Q1 750 is electrically connected to the ground VSS 720. The base of the bipolar transistor Q1 750 is electrically coupled to the resistor RPTAT 760, and the resistor network RUP 770 and RSHIFT 780. The p-channel MOSFET MPOA 730B is driven by the current flowing through the n-channel MOSFET MNOA 740. The gate of the n-channel MOSFET MNOA 740 is the control voltage VCTL.

In the circuit 700, the collector-to-emitter current in bipolar transistor QN 745A is mirrored onto bipolar transistor QN1 745B with the ratio N:1. Using a current mirror {QN 745A, QN 745B} limits the current consumption. The current is then copied back to the p-channel current mirror MPN 732A and MP1 732B where the 1:N ratio restores the previous N:1 scaling. Thus, the current in bipolar transistor Q1 750 is compared to the current to QN 745 and the result pushes or pulls the signal line voltage VCTL. This establishes a drive current which establishes the current-mode operational amplifier formed from n-channel MOSFET MNOA 740, and current mirror p-channel MOSFET MPOA 730B and p-channel MOSFET MP 730A, where the ratio MPOA:MP can be very large to be able to inject more current to the output. Additionally, the implementation in general does not have to restore exactly the ratio N:1 to 1:N. An implementation when the ratio is not restored to 1:1, but to 1:M or M:1, where M is an integer is a possibility. As long as this ratio remains constant (using mirror ratios), a PTAT behaviour can also be implemented. For example, this can lead to current IQ1 different from current IQN, but ratio well controlled between both.

The regulator voltage, VREG, is adjusted such that the signal voltage VCTL drives a given current through n-channel transistor MNOA 740; this allows prevention of signal clipping of the signal VCTL. (e.g. VCTL is not clipping up nor down). The regulator voltage VREG is adjusted to match the currents in bipolar transistor Q1 750 and bipolar transistor QN 745A. This method emulates a PTAT, with the advantage that the regulation voltage itself is referenced to the ground VSS 720.

A startup function system includes a p-channel MOSFET 785A, a p-channel MOSFET 785B, and startup resistance 790. The gate of p-channel MOSFET 785A is electrically connected to the drain of p-channel MOSFET 785B, providing a startup signal GPSTART. The gate of p-channel MOSFET 785B is connected to the p-channel current mirror {MP 730A, and MPOA 730B}. The p-channel MOSFET 785B drain is electrically connected to the resistance RSTARTUP 790.

In this embodiment, the PTAT requires a p-channel MOSFET current mirror referenced to the supply from the current mirror MPN 732A and MP1 732B; this can use the rail OUT=VREG. For example, the sources of the p-channel MOSFET current mirror are connected to the battery BAT instead of VREG.

The start-up system component GPSTART is initially discharged as long as no current flows through the amplifier. This allows the supply to connect to OUT using the "Startup MS" PMOS 785A. Once current starts flowing, GPSTART goes up to the supply and deactivates MS.

The resistance RSTARTUP 790 can be a passive or active element. For example, the resistance RSTARTUP 790 can be a source-drain resistance of a MOSFET or plurality of MOSFETs. In this embodiment, a very large startup resistance RSTARTUP 790 is desired to activate the regulator.

Other equivalent circuit embodiments can be utilized. High-voltage transistors can replace the low-voltage transistor components within the circuit embodiment. For example, the transistor MNOA 740 can be a high-voltage transistor to drive the transistor MPOA 730B, and transistor MP 730A in a high voltage domain. Additionally, other equivalent circuit embodiments also can be utilized. It is worth noting that all the bipolar NPN transistors may be replaced by NMOS in weak inversion, to eliminate the base-current errors and to reduce the total size.

Figure 8:
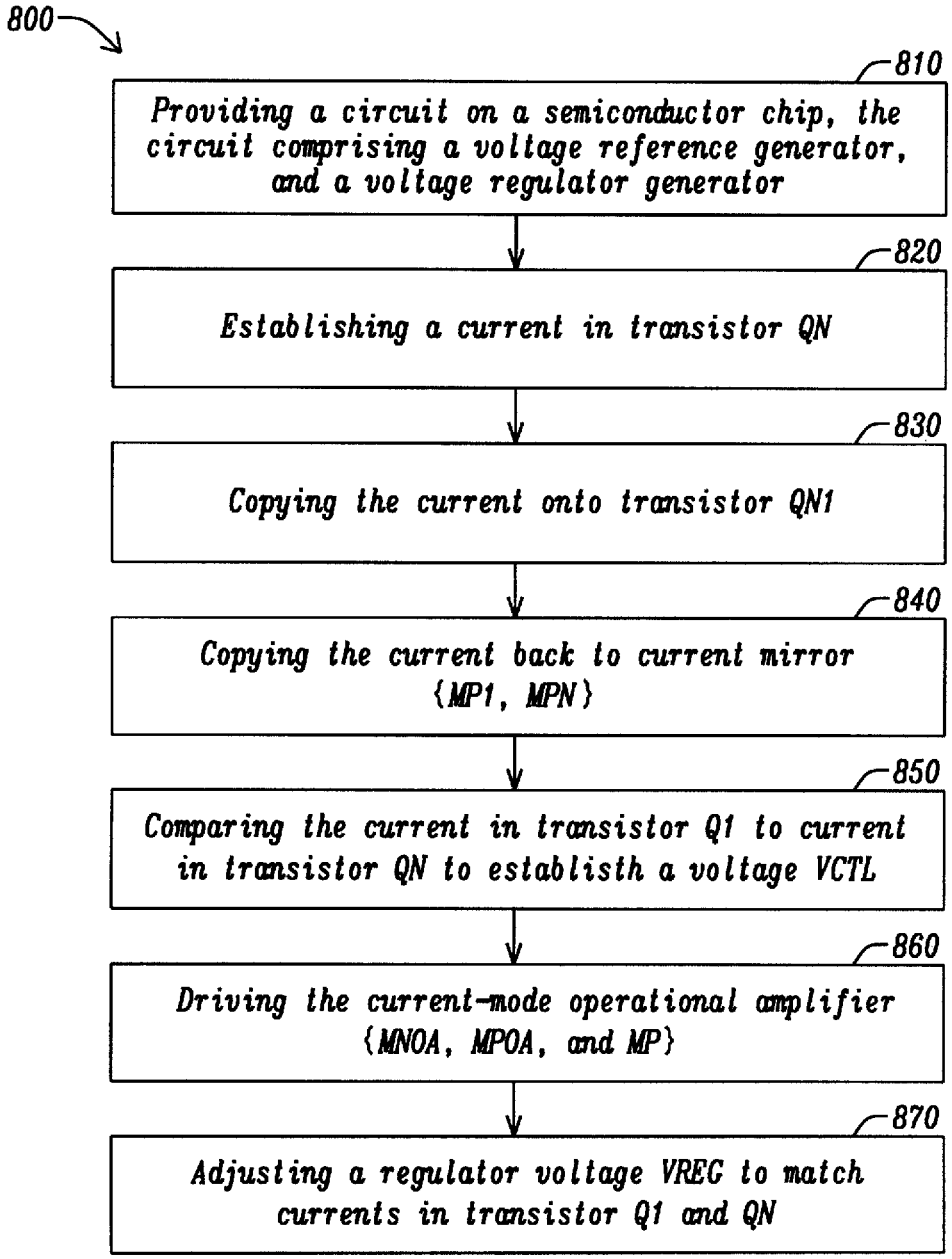

FIG. 8 is a method in accordance with the embodiment of the disclosure. A method is disclosed in accordance with the embodiment of the disclosure. A method for providing a temperature compensated high voltage 800, comprising the steps of a first step 810 providing a circuit on a semiconductor chip, the circuit comprising a voltage reference generator, and a voltage regulator generator, a second step 820 establishing a current in transistor QN, a third step 830 copying the current onto transistor QN1, a fourth step 840 copying the current back to current mirror {MP1, MPN}, a fifth step 850 comparing the current in transistor Q1 to current in transistor QN to establish a voltage VCTL, a sixth step 860 driving the current-mode operational amplifier {MNOA, MPOA, and MP}, and a seventh step 870 adjusting a regulator voltage VREG to match currents in transistor Q1 and QN.

In the method in accordance with the embodiment, in the third step 830, the current in QN is copied onto QN1 with the ratio N:1 (to limit the consumption).

In the method in accordance with the embodiment, in the fourth step 840 the current is copied back to {MP1, MPN} where the 1:N ratio restores the previous N:1 scaling.

In the method in accordance with the embodiment, in the fifth step 850 the current in Q1 is compared to the current to QN and the result pushes or pulls the line VCTL.

In the sixth step 860, this drives the current mode operational amplifier {MNOA, MPOA and MP} where the ratio MPOA:MP can be very large to be able to inject more current to the output.

In the seventh step 870, VREG is adjusted such that VCTL drives a given current through MNOA, and this means VCTL is not clipping up nor down: in other words VREG is adjusted to match the currents in Q1 and QN. We have thus emulated a PTAT, with the advantage compared to prior art that the regulation itself is referenced to the ground.

In the method in accordance with the embodiment, this can be further described from the equation equating the current through transistor QN and the transistor Q1, starting with IQN=IQ1. This means:

$$I(RPTAT) = \frac{VBE1 - VBEN}{RPTAT} = \frac{\Delta VBE}{RPTAT}$$

In the method in accordance with the embodiment, the regulated voltage VREG can be derived according to VREG:

$$VREG = VBE1 + RUP \cdot I(RUP) = VBE1 + RUP \cdot (I(RSHIFT) + I(RPTAT))$$

$$VREG = VBE1 + RUP \cdot \left(\frac{VBE1}{RSHIFT} + \frac{\Delta VBE}{RPTAT}\right)$$

Finally:

$$VREG = VBE1 \cdot \left(1 + \frac{RUP}{RSHIFT}\right) + \Delta VBE \cdot \left(\frac{RUP}{RPTAT}\right)$$

This equation is made of a VBE1 term that decreases with temperature, and a □VBE term that increases with temperature. By calculating properly RUP, RPTAT, RSHIFT and N (that is embedded in □VBE), we can both choose the value of VREG and also compensate it in temperature.

Other equivalent circuit embodiments also can be utilized. Equivalent reference voltage and voltage regulator generators can be merged to provide temperature compensation at voltages above 1.2 V.

It should be noted that the description and drawings merely illustrate the principles of the proposed methods and systems. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and systems and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed is:

1. A low-dropout (LDO) regulator circuit providing a regulated, temperature compensated output voltage down from a high-voltage supply comprising:

an output branch, comprising: a port for the regulated output voltage, a voltage-divider resistor network connected between said port for the regulated output voltage and ground, wherein the resistor network is configured to provide a voltage (VBE1) which is connected to a base of a first transistor, wherein a current through the output branch is provided by an operational amplifier;

an emulated proportional to absolute temperature (PTAT) circuit configured to generate a temperature-independent current through a first transistor which is used as a reference current, wherein the PTAT circuit comprises;

a PTAT resistor having its first terminal connected to a node of the output branch, which is between a first and the second resistor of the voltage divider resistor network and its second terminal connected to a collector and a base of a second transistor; and said second transistor having its base connected to a base of a third transistor and its emitter connected to ground voltage, wherein the reference current through the second transistor is mirrored in a first current mirror by a ratio of N:1 to the third transistor, wherein current mirror factor N is an integer number higher than 1;

said operational amplifier configured to inject current into the output branch; and a second current mirror mirroring the current through the third transistor by a first p-channel MOSFET using a current mirror ratio of 1:N, wherein N is the same current mirror factor as used by the first current mirror, to a second p-channel MOSFET, wherein the current through the second MOSFET is flowing through the first transistor to ground and wherein a voltage of a node between the second MOSFET and the first transistor is a regulation voltage of the operational amplifier; wherein the first and the second current mirrors are configured to compare the reference current through the second transistor with the current through the first transistor and a comparison result raises or lowers the voltage (VCTL) that regulates the operational amplifier, wherein the voltage (VCTL) that regulates the operational amplifier is ground referenced for better PSSR and noise immunity.

2. The circuit, as recited in claim 1, wherein said operational amplifier comprises a third and a fourth p-channel MOSFET, wherein both third and fourth p-channel Mosfets are connected in a current mirror configuration, and a n-channel MOSFET, configured to provide the current through the output branch, wherein the sources of the third and the fourth p-channel MOSFETs are connected to VDD voltage, a gate and a drain of the third p-channel MOSFET is connected to the gate of the fourth p-channel MOSFET, a drain of the fourth p-channel MOSFET is connected to the port for the regulated output voltage and the drain of the third p-channel MOSFET is connected to a drain of the n-channel MOSFET, wherein a gate of the n-channel MOSFET is connected to the regulation voltage and a source of the n-channel MOSFET is connected to ground.

3. The circuit, as recited in claim 2, wherein said regulated output voltage adjusted such that the regulation voltage of the operational amplifier drives a given current through then-channel MOSFET, avoiding signal clipping of the said control signal voltage (VCTL).

4. The circuit, as recited in claim 3, wherein said regulated output voltage is adjusted to match the currents in said first transistor and said second transistor, wherein said regulated output voltage is referenced to the ground VSS.

5. The circuit, as recited in claim 2, further comprising a startup circuit, configured to provide the voltage (VCTL) that regulates the operational amplifier as long as no current flows through the operational amplifier, comprising:

a startup resistor (RSTARTUP), wherein a first terminal of the startup resistor is connected to ground and a second terminal of the startup resistor is connected to a gate of a first startup p-channel MOSFET and to a drain of a second startup p-channel MOSFET;

said first startup p-channel MOSFET configured to provide a current for said second current mirror, wherein a source of the first p-channel MOSFET is connected to VDD voltage and a drain of the first startup p-channel MOSFET is connected to the port of the regulated output voltage of the LDO; and said second startup p-channel MOSFET configured to provide current to said startup resistor (RSTARTUP), wherein a gate of the second start-up p-channel MOSFET is connected to the gates of the third and fourth MOSFET hence enabling the startup circuit to shut down when a current is flowing through the operational amplifier.

6. The circuit, as recited in claim 5, wherein said first startup p-channel MOSFET is configured to provide a signal (GPSTART) on its gate electrode.

7. The circuit, as recited in claim 1, wherein said second current mirror comprises a first and a second p-channel MOSFET, wherein the sources of the first and the second p-channel MOSFETs are connected to the port for the regulated output voltage, a drain and a gate of the first p-channel MOSFET are connected to a gate of the second p-channel MOSFET and to a collector of the third transistor and a drain of the second MOSFET is connected to a collector of the first transistor and to the node of the regulation voltage of the operational amplifier.

8. The circuit, as recited in claim 1, wherein said voltage divider resistor network generates a reference voltage (VREF).

9. The circuit, as recited in claim 1, wherein said first current mirror is configured to limit the current consumption.

10. The circuit, as recited in claim 9, wherein the second current mirror is configured to provide a copy to said first current mirror where the 1:N ratio of the second current mirror restores the N:1 scaling of the first current mirror.

11. The circuit, as recited in claim 1, wherein the current mirror ratios of the first and second current mirrors remains constant.

12. The circuit, as recited in claim 11, wherein the current through the first transistor is different from the current through the second transistor and the mirror ratio is well controlled in said first and second current mirrors.

13. The circuit of claim 1, wherein said first, second and third transistors are bipolar npn transistors.

14. A method of providing a regulated temperature compensated voltage down from a high voltage supply by a LDO, comprising the steps of:

(a) providing an LDO circuit on a semiconductor chip, comprising an operational amplifier, a port for the regulated output voltage of the LDO, a resistive output voltage divider comprising a first and a second resistor connected in series between the port for the regulated output voltage and ground, wherein a node between the first and the second resistor provides a voltage proportional to the regulated output voltage and a bandgap reference current generator and a voltage regulator generator, (b) establishing a bandgap reference current in a first circuit branch between a voltage representing the regulated output voltage of the LDO and ground, (c) mirroring said bandgap reference current to a second circuit branch deployed between the regulated output voltage of the LDO and ground using a current mirror ratio of N:1, (d) mirroring the current of the second circuit branch reverse to a third circuit branch using a current mirror ratio of 1:N, wherein the third circuit branch is deployed between the regulated output voltage of the LDO and ground, wherein the current of the third branch is flowing through collector and emitter of a control transistor (Q1) having a base connected to the node providing the voltage proportional to the regulated output voltage of the LDO and wherein a node at the collector of the control transistor is configured to provide a regulation voltage (VCTL) for the operation amplifier, wherein the voltage (VCTL) that regulates the operational amplifier is ground referenced for better PSSR and noise immunity, (e) comparing the current of the second circuit branch with the current of the third branch, wherein a comparison result pushes or pulls the regulation voltage of the operation amplifier, which is configured to inject current to the output port, wherein finally the regulated output voltage of the LDO is adjusted to match the bandgap reference current and the current through the control transistor.

15. The method of claim 14, wherein the bandgao reference current and the current through the control transistor (Q1) are equated according to $$I(RPTAT) = \frac{VBE1 - VBEN}{RPTAT} = \frac{\Delta VBE}{RPTAT}$$

wherein I(RPTAT) is the bandgap reference current through a PTAT resistor of the bandgap reference current generator, RPTAT is a resistance of the PTAT resistor of the bandgap reference current generator, VBE1 is a base to emitter voltage of the control transistor (Q1) and VBEN is a voltage drop across a transistor of the bandqap reference current generator.

16. The method of claim 15, wherein the regulated output voltage of the IDO (VREG) can be derived according the equations:

$$VREG = VBE1 + RUP \cdot I(RUP) = VBE1 + RUP \cdot (I(RSHIFT) + I(RPTAT))$$

$$VREG = VBE1 + RUP \cdot \left(\frac{VBE1}{RSHIFT} + \frac{\Delta VBE}{RPTAT}\right)$$

or $$VREG = VBE1 \cdot \left(1 + \frac{RUP}{RSHIFT}\right) + \Delta VBE \cdot \left(\frac{RUP}{RPTAT}\right),$$

wherein RUP is the resistance of the first resistor of the resistive output voltage divider and RSHIFT is the resistance of the second resistor of the resistive output voltage divider.

17. The method of claim 16, wherein said base-emitter voltage, VBE1, decreases with temperature, and the ΔVBE term increases with temperature.

18. The method of claim 17, wherein calculating a value of the resistance of the first resistor of the resistive output voltage divider (RUP), a value of the resistance of the bandgap resistor (RPTAT), a value of the resistance of the second resistor of the resistive output voltage divider (RSHIFT) and ΔVBE, a value of the regulated output voltage (VREG) and temperature compensation can be evaluated.

* * * * *